US006178713B1

(12) United States Patent
Delie et al.

(10) Patent No.: US 6,178,713 B1
(45) Date of Patent: Jan. 30, 2001

(54) MOUNTING SYSTEM FOR PANELS FOR USE IN FACADE CLADDING ON BUILDINGS

(75) Inventors: Hugues C. Delie, Reims (FR); Math J. W. Mourmans, Eindhoven (NL)

(73) Assignee: Trespa International B.V., Wetering (NL)

( * ) Notice: Under 35 U.S.C. 154(b), the term of this patent shall be extended for 0 days.

(21) Appl. No.: 09/203,994

(22) Filed: Dec. 1, 1998

(30) Foreign Application Priority Data

Dec. 4, 1997 (DE) ..... 197 53 768

(51) Int. Cl.[7] ..... E04B 2/30

(52) U.S. Cl. ..... 52/506.08; 52/238.1; 52/481.2; 52/483.1; 52/506.04

(58) Field of Search ..... 52/506.08, 506.04, 52/461.1, 482.2, 508, 509, 235, 238.1, 213, 483.1

(56) References Cited

U.S. PATENT DOCUMENTS

| | | | | |
|---|---|---|---|---|
| 3,305,981 | * | 2/1967 | Biggs et al. | 52/461.1 X |
| 3,705,002 | | 12/1972 | Varlonga . | |
| 3,731,447 | * | 5/1973 | Dawdy et al. | 52/489 |
| 3,753,325 | * | 8/1973 | Stanley et al. | 52/489 |
| 3,852,935 | * | 12/1974 | Jones | 52/730 |
| 3,925,948 | * | 12/1975 | Sauer et al. | 52/481 |
| 4,835,923 | * | 6/1989 | Ybarra | 52/238.1 |
| 4,893,446 | * | 1/1990 | Gudmundsson et al. | 52/238.1 |
| 4,934,119 | * | 6/1990 | Ybarra | 52/236.1 |

FOREIGN PATENT DOCUMENTS

| | | |
|---|---|---|
| 3627583 | 2/1988 | (DE) . |
| 94 16 917 | 10/1994 | (DE) . |
| 0 304 607 | 11/1989 | (EP) . |
| 0 761 904 A1 | 7/1995 | (EP) . |

* cited by examiner

*Primary Examiner*—Carl D. Friedman
*Assistant Examiner*—Yvonne M. Horton
(74) *Attorney, Agent, or Firm*—Roberts & Mercanti, LLP

(57) ABSTRACT

A mounting system comprises base structural supports and connecting structural supports which are fastened horizontally to vertical structural supports. The vertical structural supports are connected to a building wall. Each base structural support has a U-like cross section, in which the upwardly directed leg that is further away from the building wall is shorter than the leg fastened to the vertical structural supports. Each connecting structural support has a short, upwardly and downwardly directed leg that is further away from the building wall than a vertical leg that is connected to the vertical structural supports. A horizontal leg which has a flexible elastic insert at its open end, adjoins the lower end of the vertical leg.

19 Claims, 3 Drawing Sheets

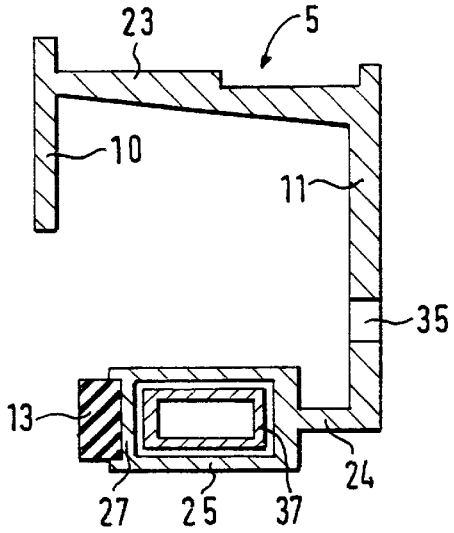
Fig. 4b
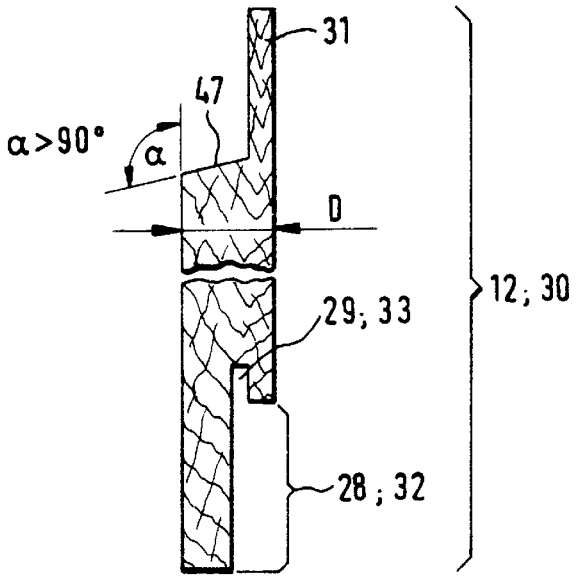
Fig. 5
Fig. 6
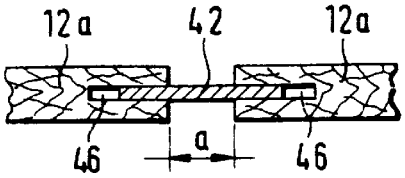
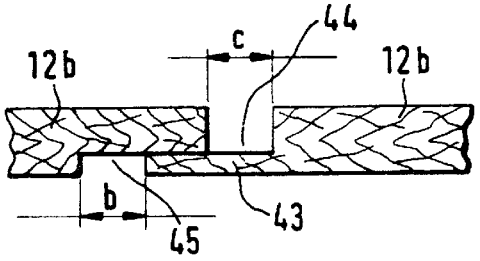
Fig. 7

MOUNTING SYSTEM FOR PANELS FOR USE IN FACADE CLADDING ON BUILDINGS

BACKGROUND OF THE INVENTION

1. Field of the Invention

The invention relates to a mounting system for panels for use in facade cladding on buildings and for invisible fastening of the panels on structural supports that are connected to a building wall.

2. Description of the Related Art

EP-A-0 761 904 describes a mounting system for panels for use in facade cladding on buildings. The mounting system comprises structural supports and U-shaped hooks which are connected, by means of a fastening element to that side of the panel facing a building wall. Angle structural supports are fastened to the building wall, the longer angle sides of these structural supports extending into the space between side walls of the hook and have punched openings. Bolts are pushed through holes in the side walls and through the punched openings, which bolts are fixed in their position in relation to the respective hook.

German Utility Model G 94 16 917.9 discloses a fastening system for compact panels made of one or more fiber layers which are hot-pressed together with one another and impregnated with resin and which are externally coated on at least one side with a decorative layer, for invisible mounting on a support body. The fastening system consists of a structural support which interconnects the compact panels and a wall or a support body, and milled cuts are made in those sides of the compact panels facing the support body. The cross sections of which milled cuts are covered by portions of the structural support. Each individual milled cut consists of two cross sections which are arranged on the compact panel in a mirror-inverted manner in relation to a vertical, run at an angle to the surface of the compact panel and enclose between them an angle of 50 to 100°. The cross sections receive square-shaped portions of the structural support. An end-piece of the structural support is of V-shaped design and the portions form the end sections of the V-shape.

The core of compact panels has very great strength and can therefore absorb great forces without breaking or deforming. Compact panels or similar panels are used in particular for facade and wall cladding on account of their great weathering resistance and dimensional stability, care being taken that the fastening of the panels to a wall or a support body is invisible from the outside. According to the state of the art, invisible fastening is brought about by the panels being adhesively bonded or fastened by screws. In the case of screw connections, these are made directly to the panels, the dowels in general being fixed in the panels. Connection to the wall lying behind or to the support body located behind is carried out via, for example, clips.

According to the state of the art, it is also customary to fasten metal hooks in a hole on the rear side of the panels using screws or dowels. The panels are then suspended in metal rails fastened in vertical structural supports connected to the wall or to the building. The rails may also be arranged on adjustable facade anchors. On the upper edge, each of these panels has two adjustable fasteners and one fixed fastener which is designed as a so-called fixed point. The lower fasteners must be attached higher than the lower edge of the panel so as to allow changes in dimensions of the panel and its substructure. The fasteners are, in general, clamps which may, for example, be of semicircular design. In this system, mounting and demounting work is time-consuming because individual panels must in each case be suspended on a metal rail. Adjustment of the panels in the horizontal and the vertical direction requires laborious work on the rear side of the panel which has to be removed in order, for example, to reposition the metal rail in the vertical structural support or to realign facade anchors if these are used. Only after these adjustment operations is it possible for the panel to occupy its new position on the facade substructure.

The object of the invention is to provide a mounting system which makes possible rapid mounting of facade cladding panels, keeps the number of system components low and reduces the costs of facade cladding equipped with invisible fastening means.

SUMMARY OF THE INVENTION

The invention provides a mounting system for panels for use in facade cladding on buildings and for invisibly fastening the panels on structural supports that are connected to a building wall, wherein the mounting system comprises a) at least one base structural support and at least one connecting structural support, which base and connecting structural supports are fastened horizontally to at least one vertical structural support, the vertical structural support being connected to a building wall;

b) wherein each base structural support has a U-shaped cross section, which has a first upwardly directed leg attached to the vertical structural support, which first upwardly directed leg is connected at a lower end thereof to an end of a horizontal leg; and a second upwardly directed leg connected to another end of the horizontal leg further away from the vertical structural support; and c) wherein each connecting structural support has a U-shaped cross section having a central vertical leg that is connected to the vertical structural supports, an upper horizontal leg being attached at one thereof to an upper end of the vertical leg and having a short upwardly and downwardly directed leg attached to the upper horizontal leg at another end thereof away from the vertical structural support; and a lower horizontal leg connected at one end thereof to the vertical leg at a lower end thereof, the lower horizontal leg having an open end at another end thereof away from the vertical leg; and a flexible elastic insert being provided at the open end.

The invention also provides a mounting system for panels for use in facade cladding on buildings and for invisible fastening of the panels on structural supports that are connected to a building wall, wherein the mounting system comprises base structural supports and connecting structural supports which are fastened horizontally to vertical structural supports the vertical structural supports being connected to the building wall, wherein each base structural support has a U-like cross section, in which cross section the upwardly directed leg that is further away from the building wall is shorter than the leg fastened to the vertical structural supports, and wherein each connecting structural support has a short, upwardly and downwardly directed leg that is further away from the building wall than a vertical leg that is connected to the vertical structural supports, a horizontal leg, which has a flexible elastic insert at its open end, adjoining the lower end of this vertical leg.

BRIEF DESCRIPTION OF THE DRAWINGS

The invention is explained in greater detail below with the aid of the drawings, in which:

FIG. 4*b* shows a section through a connecting structural support that has been slightly modified in relation to the embodiment in FIG. 4*a*.

FIG. 5 shows a longitudinal section through a panel of the facade cladding that is erected with the aid of the mounting system according to the invention.

FIG. 6 shows a sectional plan view of two interconnected panels of the facade cladding.

FIG. 7 shows a sectional plan view of two interconnected panels of the facade cladding, similar to the arrangement in FIG. 6.

DETAILED DESCRIPTION OF THE PREFERRED EMBODIMENT

According to the invention, this object is achieved by virtue of the fact that the mounting system has base structural supports and connecting structural supports which are fastened horizontally to vertical structural supports, the vertical structural supports being connected to the building wall. Each base structural support has a U-like cross section, in which cross section the upwardly directed leg that is further away from the building wall is shorter than the leg fastened to the vertical structural supports. Each connecting structural support has a short, upwardly and downwardly directed leg that is further away from the building wall than a vertical leg that is connected to the vertical structural supports, and a horizontal leg, which has a flexible elastic insert at its open end, adjoining the lower end of this vertical leg.

The mounting system therefore requires only two types of structural support, namely a base structural support and a connecting structural support, which differ from one another in their design.

In one embodiment, the base structural support has the two vertical legs of different length interconnected by a horizontal leg. In another embodiment, the base structural support has the vertical leg with an offset horizontal upper end, a horizontal leg offset from the leg and a hollow structural support of rectangular cross section fastened to the horizontal leg. In this embodiment, the two outer sides of the hollow structural support extend, as a vertical leg and a horizontal leg, beyond the hollow structural support.

In the invention, one embodiment of the connecting structural support has an upwardly and downwardly directed leg, an upper horizontal straight leg, a vertical leg and a lower horizontal leg, the lower leg being widened in a claw-like manner at its open end and receiving the insert. This insert faces away from the building wall. Expediently, the lower horizontal leg, including its open claw-like end and the insert, is shorter than the upper horizontal leg. This measure takes account of the fact that the inner side of a panel can bear against the insert and is at the same time in contact, via the outer side of its upper end, with the inner side of the downwardly directed vertical leg of a connecting structural support.

In another development of the invention, the connecting structural support has an upwardly and downwardly directed leg, an upper horizontal, a bent leg, a vertical leg and a lower horizontal leg. A hollow structural support of rectangular cross section is fastened to the lower leg. In this embodiment, the outer side of the hollow structural support, which side faces away from the vertical leg, is expediently shaped in a claw-like manner and receives the insert.

Figure 8:
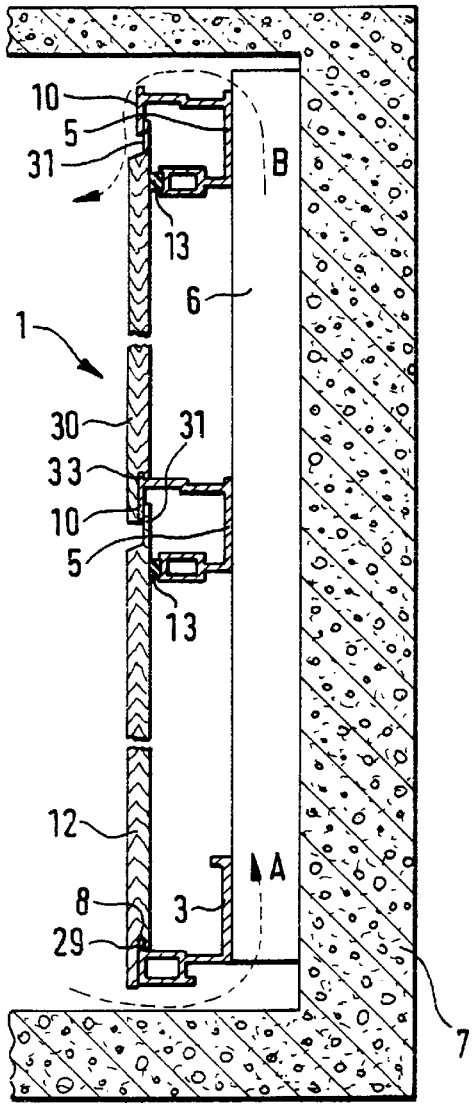
FIG. 8 shows a sectional view of the facade cladding that is erected using the mounting system according to the invention.
Figure 9:
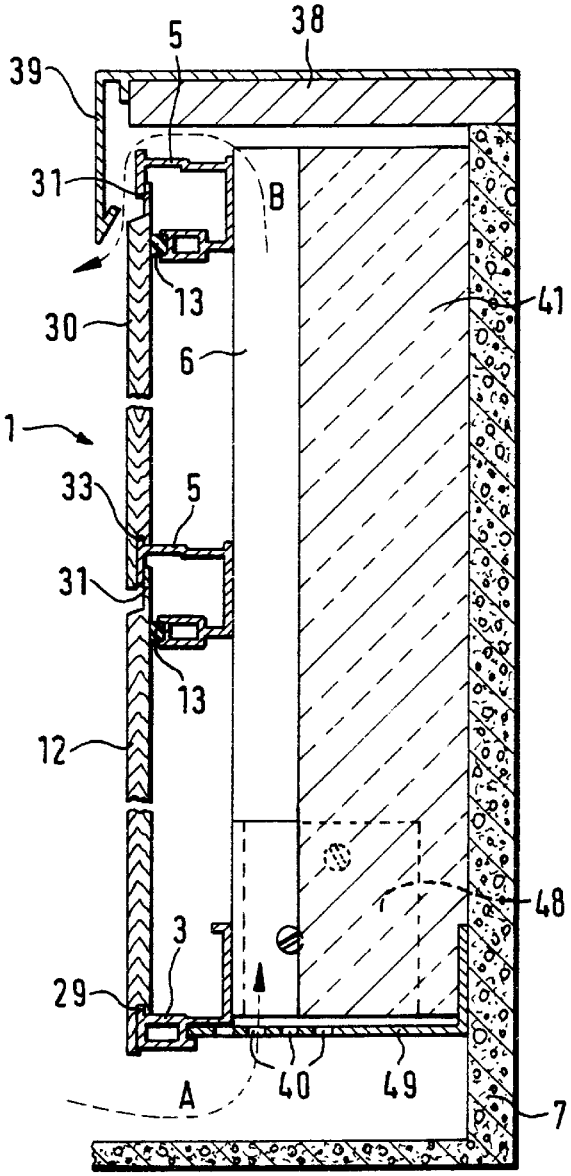
FIG. 9 shows a sectional view of facade cladding that is erected using a mounting system that has been slightly modified in relation to FIG. 8.

A mounting system 1, as illustrated in FIGS. 8 and 9, comprises base structural supports 3 and connecting structural supports 5 which are fastened horizontally to vertical structural supports 6 which in turn are connected to a building wall 7 as in the case in FIG. 8. By means of the mounting system 1, panels 12, 30 can be fastened invisibly on the base structural supports 3 and the connecting structural supports 5. The arrangement of the panels on the structural supports extensively conceals the latter and renders them invisible to a person looking at the facade cladding. The base structural supports 3 and connecting structural supports 5 illustrated in FIGS. 8 and 9 represent the preferred embodiments of the structural supports but they can also be replaced by simple base structural supports 2, as shown in FIG. 1, and simpler connecting structural supports 4, as shown in FIG. 3.

Figure 1:
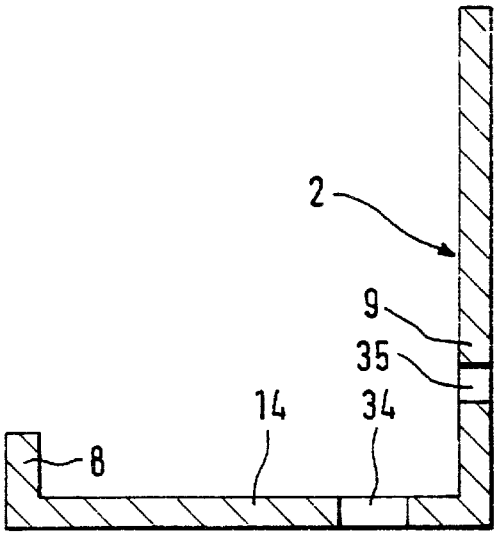
FIG. 1 shows a section through a first embodiment of a base structural support of the mounting system according to the invention.

The base structural support 2 illustrated in FIG. 1 comprises two vertical legs 8 and 9, the leg 8 being considerably shorter than the leg 9. The two legs 8 and 9 are interconnected by a horizontal leg 14 which has openings 34. This base structural support 2 is connected to the vertical structural support 6 in FIG. 8, for example via the leg 9 by means of screws (not shown). The openings 34 serve for drainage of condensation water. The base structural support 2 is arranged at the lower end of vertical facade cladding and supports the bottom panels 12 of the facade cladding.

Figure 2:
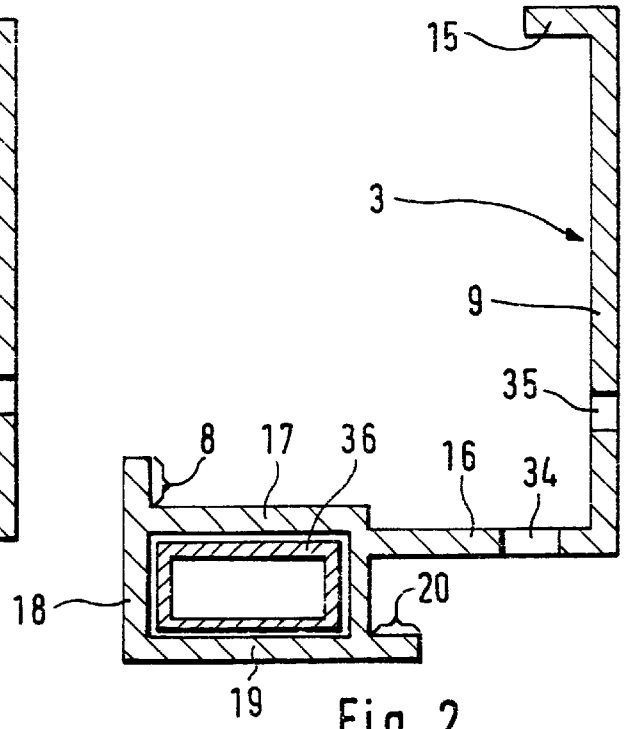
FIG. 2 shows a section through a second embodiment of a base structural support of the mounting system according to the invention.

The preferred embodiment of the base structural support is the base structural support 3 illustrated in FIG. 2, which is of more complex design in relation to the base structural support 2. Like the base structural support 2, the base structural support 3 has a U-shaped cross section and comprises a vertical leg 9 with an offset horizontal upper end 15, a horizontal leg 16 offset from the leg 9 and a hollow structural support 17 of rectangular cross section which adjoins the horizontal leg 16. Openings 35 for fastening to the vertical structural supports 6 are arranged in the vertical leg 9, and openings 34 for drainage of condensation water are arranged in the horizontal leg 16. Two outer sides 18, 19 of the hollow structural support 17 extend beyond the outer cross section of the hollow structural support and continue in a vertical leg 8, which is directed upward, and a horizontal leg 20 which points toward the vertical leg 9. During mounting, a rectangular structural support 36 is inserted into the hollow structural support 17, as indicated in FIG. 2. The length of the rectangular structural support 36 is dimensioned in such a manner that it interconnects two adjacent base structural supports 3, 3 aligned on the same horizontal and in this way increases the stability of the mounting system and of the facade cladding.

Figure 3:
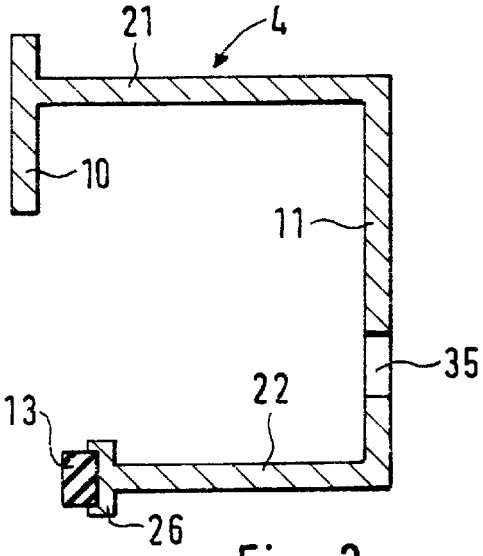
FIG. 3 shows a section through a first embodiment of a connecting structural support of the mounting system according to the invention.

FIG. 3 shows the connecting structural support 4 that constitutes a first embodiment. The connecting structural support 4 comprises an upwardly and downwardly directed vertical leg 10, an upper horizontal, rectilinear leg 21, a vertical leg 11 and a lower horizontal leg 22. The lower leg 22 is widened at its open end 26 in a claw-like manner and receives an insert 13 which is made of a flexible elastic material such as rubber, plastic or the like. The connecting structural support 4 is formed in such a manner that the lower horizontal leg 22, together with its open claw-like end 26 and the insert 13 projecting from the end 26, is shorter than the upper horizontal leg 21. This embodiment, combined with the profiling of the panels 12 and 30 of the facade cladding, brings about secure fastening of the panels and the simultaneous concealment of the connecting structural support 4 by the panels so that, viewed from the outside of the facade cladding, the structural support remains invisible, as will be described in greater detail in connection with FIGS. 8 and 9. Openings 35 for fastening to the vertical structural supports 6 are provided in the vertical leg 11. The vertical leg 11 is connected to the vertical structural supports 6 of the mounting system 1 by means of screws (not shown).

Figure 4A:
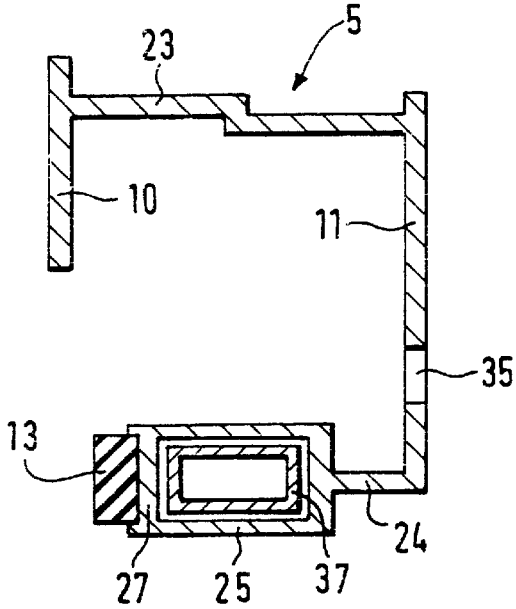
FIG. 4*a* shows a section through a second embodiment of a connecting structural support of the mounting system according to the invention.

The connecting structural support 5 according to FIG. 4*a* constitutes a second, preferred embodiment and comprises the upwardly and downwardly directed vertical leg 10, an upper horizontal bent leg 23, the vertical leg 11 and a lower horizontal leg 24. This is adjoined by a hollow structural support 25 of rectangular cross section. In the vertical leg 11, there are openings 35 for fastening to the vertical structural supports 6. By way of modification of FIG. 4*a*, the vertical leg 11 is dimensioned so as to be thicker than the legs 10 and 24. Furthermore, the upper leg 23 is reinforced at an angle on its lower side, that is to say it has an angled lower side which does not have the bend of the upper side of the leg 23, as FIG. 4*b* shows. It can be seen from FIGS. 8 and 9 how this connecting structural support 5 is used in order to interconnect two panels 12 and 30 arranged vertically one above the other. An outer side 27 of the hollow structural support 25, which side faces away from the vertical leg 11, is shaped in a claw-like manner and receives the insert 13. It is true of the second embodiment also that the lower horizontal leg 24, together with the hollow structural support 25 and the projecting insert 13, is shorter than the upper horizontal, bent leg 23. During mounting, a rectangular structural support 37 is inserted into the hollow structural support 25, said structural support 37 being dimensioned in such a manner that it is long enough to interconnect two adjacent structural supports 5, 5 aligned on the same horizontal and in this way increase the stability of the mounting system and of the facade cladding.

A comparison of the first and the second embodiment of the base structural supports 2, 3, in the same way as a comparison of the first and second embodiment of the connecting structural supports 4, 5, reveals that the second embodiments are distinguished from the first embodiments essentially only by the additional hollow structural supports 17, 25. These hollow structural supports 17, 25 afford the advantage that it is possible to insert into them rectangular structural supports 36 and 37 respectively, which interconnect adjacent base structural supports and connecting structural supports respectively and in this way increase the stability of the mounting system and of the facade cladding.

FIG. 5 shows a longitudinal section through the panels 12 and 30 of the facade cladding. In this respect, it is to be noted that both the panels 12 arranged in the bottom horizontal row of the facade cladding and the panels 30 arranged in rows situated above said row have the same shape. Each of the panels 12, 30 is indented at the upper end and has a web rim 31 which has a thickness of 2 to 4 mm and a length of 12 to 18 mm. The thickness D of the panels ranges from 8 to 16 mm, the height from 200 to 1200 mm. The web rim 31 is created as a result of an indentation at the upper end of the panel 12, 30 in such a manner that a bottom surface 47 of the indentation runs at an angle to a wall of the web rim 31 and, with this wall, encloses an angle $\alpha>90°$, in particular in the range of 100 to 105°. There is likewise an indentation 28, 32 respectively on the lower side of the panel 12, 30, which indentation has, at least, a depth of 4 to 5 mm and a length of 14 to 18 mm. This indentation 28, 32 is provided with a groove 29, 33 respectively which has a width of at least 1.6 to 2 mm and a depth of at least 3 to 4 mm. The material thickness of the panel 12, 30 located to the right of this groove 29, 33 respectively in FIG. 5 is the same as the thickness of the web rim 31. The web rim 31 is located on the inner side, or rear side, of the panel 12, 30 of the facade cladding.

The sectional plan view in FIG. 6 shows two panels 12*a* which are separated from one another by a joint width a. Each of the panels 12*a* has a groove 46, into which a connecting plate 42 is inserted. This connecting plate 42 is preferably a metal plate such as, for example, an aluminum plate with a thickness of 2 to 3 mm corresponding to the width of the groove 46 and a width of 30 to 40 mm.

FIG. 7 also shows a sectional plan view of two interconnected panels 12*b*, 12*b* of the facade cladding. The right panel 12*b* in this plan view has an indentation 44 while the left panel 12*b* has an indentation 45 which is shallower than the indentation 44. The indentation 44 of the right panel 12*b* leaves a panel web 43. The two panels 12*b*, 12*b* are pushed together in such a manner that the panel web 43 is in contact with the left panel 12*b*, a joint width b remaining between the two panels. On the rear side, or inner side, of the panels, which faces upward in FIG. 7, there is a panel joint c between the two panels 12*b*, 12*b*.

The sectional view according to FIG. 8 shows facade cladding that is erected using the mounting system 1. The bottom row of panels 12 is in engagement with the base structural supports 3 by virtue of the fact that the short vertical leg 8 of the base structural support 3 engages in the groove 29 of the panels 12. At the same time, the bottom panels 12 conceal the base structural supports 3 completely. Between the lower edge of the panels 12 and the floor there is a space through which incoming air A flows in according to the arrow. This air then flows up along the inner side of the facade cladding and comes out as outgoing air B at the upper end of the facade cladding. The connecting structural supports 5 join the bottom panels 12 together with the panels 30 located vertically above them by virtue of the fact that the inserts 13 of the connecting structural supports 5 bear against the inner sides of the panels 12, and the web rims 31 on the upper sides of these panels 12 bear against the inner sides of the downwardly directed legs of the connecting structural supports 5. The upwardly directed parts of the short vertical legs 10 of the connecting structural supports 5 engage in the groove 33 on the lower sides of the panels 30. The panels 30 have indentations on the inner sides, which leave webs which conceal completely on the outer side the legs 10 of the connecting structural supports. The upper end-structural supports of the facade cladding are likewise connecting structural supports 5, the vertical legs 10 of which are not concealed on the outer side. The web rims 31 of the panels 30 bear against the inner sides of the legs 10. Both the base structural supports 3 and the connecting structural supports 5 used as end-structural supports are in each case arranged at a defined distance from the floor or ceiling so as to ensure that there is adequate air circulation and thus rear-ventilation of the facade cladding.

Installation of the facade cladding is carried out in a series of stages. In the first stage, the vertical structural supports 6 are fastened to the building wall 7. In a second stage, the base structural supports 2 or 3 are arranged, aligned horizontally, on the vertical structural supports. The distance between these structural supports depends on the width and the height of the panels or slabs to be installed. In the third stage, the connecting structural supports 4, 5 are adjusted and fastened to the vertical structural supports 6. In the fourth stage, a small quantity of an adhesive is applied in the center of the profiling on the lower side of each panel, that is to say each panel is adhesively bonded to the structural support located below it so as to prevent displacement on one side to the left or the right beyond the horizontally aligned structural supports. In the fifth stage, the panels are first brought into engagement, via their upper side, with the connecting structural supports 4 or 5 located above them and then pushed downward until they engage with the connecting structural supports located below them. In this way, the panels are secured against being pulled out as a result of low pressure produced by wind incursion or on account of the action of other mechanical forces and, moreover, the connecting structural supports are concealed so that they are invisible from the outer side of the facade cladding. FIG. 8 shows facade cladding as preferably used for internal-wall cladding.

FIG. 9 shows facade cladding similar to that in FIG. 8. A supporting structure or a vertical structural support 6 made, for example, of wood or aluminum is fastened at a distance from the building wall 7. Thermal insulation 41 is located between the supporting structures. Furthermore, corner pieces 48 are provided, with which a horizontally aligned end cover plate 49 is fastened to the supporting structure. The connection between lower and upper panels 12 and 30 respectively is made via the connecting structural supports 5. The end of the facade cladding is likewise formed by connecting structural supports 5. A crossbeam 38 is arranged above the facade cladding and is concealed by an angular cover plate 39. The crossbeam 38 is, for example, embedded at one end in the building wall 7. Located between the thermal insulation 41 and the structural supports 3 and 5 is a duct, through which the incoming air A and the outgoing air B flow so as to ventilate the rear of the facade cladding. The lower side of the facade cladding is ended by the L-shaped end cover plate 49 with openings 40 in the longer of the two legs, which runs horizontally, while the shorter leg is fastened to the building wall 7. The longer leg of the end cover plate 49 adjoins the base structural supports 3 continuously and its openings 40 serve for drainage of condensation water. The embodiment in FIG. 9 shows typical facade cladding for an external wall of a building.

What is claimed is:

1. A mounting system for panels for use in facade cladding on buildings and for invisibly fastening the panels on structural supports said mounting system being adapted to be connected to a building wall, wherein the mounting system comprises a) at least one base structural support and at least one connecting structural support, which base and connecting structural supports are fastened horizontally to at least one vertical structural support, the vertical structural support being connectable to a building wall;

b) wherein each base structural support has a U-shaped cross section; which has a first upwardly directed leg attached to the vertical structural support, which first upwardly directed leg is connected at a lower end thereof to an end of a horizontal leg; and a second upwardly directed leg connected to another end of the horizontal leg further away from the vertical structural support; and c) wherein each connecting structural support has a U-shaped cross section having a central vertical leg that is connected to the vertical structural supports, an upper horizontal leg being attached at one end thereof to an upper end of the vertical leg and having a short upwardly and downwardly directed leg attached to the upper horizontal leg at another end thereof away from the vertical structural support; and a lower horizontal leg connected at one end thereof to the vertical leg at a lower end thereof, the lower horizontal leg having an open end at another end thereof away from the vertical leg; and a flexible elastic insert being provided at the open end.

2. The mounting system as claimed in claim 1, wherein the two vertical legs of the base structural support have different length.

3. The mounting system as claimed in claim 1, wherein the first vertical leg has a horizontal member at an upper end thereof, and a hollow structural support of rectangular cross section fastened to the horizontal leg.

4. The mounting system as claimed in claim 3, wherein two outer sides of the hollow structural support extend, as a vertical leg and a horizontal leg beyond the hollow structural support.

5. The mounting system as claimed in claim 1, wherein the connecting structural support comprises a widened claw at its open end for receiving the insert.

6. The mounting system as claimed in claim 5, wherein the lower horizontal leg of the connecting structural support including its open end claw and the insert is shorter than the upper horizontal leg.

7. The mounting system as claimed in claim 1, wherein the upper horizontal leg of the connecting structural support has at least two stepwise offset horizontal segments; and the connecting structural support further comprises a hollow structural support of rectangular cross section fastened to an end of the lower horizontal leg.

8. The mounting system as claimed in claim 7, wherein the hollow structural support of the lower horizontal leg comprises a claw which receives the insert.

9. The mounting system as claimed in claim 8, wherein the lower horizontal leg, together with its hollow structural support and insert is shorter than the upper horizontal leg.

10. The mounting system as claimed in claim 1, further comprising a facade cladding having at least one panel, wherein the bottom panels of the facade cladding have on the inner side an indentation and a groove which are in engagement with the upwardly directed vertical leg of the base structural support and wherein the bottom panels conceal the base structural supports.

11. The mounting system as claimed in claim 10, wherein the insert of the connecting structural support bears against an inner side of the panel and a web rim on an upper side of the panel bears against an inner side of the downwardly directed leg of the connecting structural support.

12. The mounting system as claimed in claim 10, wherein the panels are provided on their inner side with an indentation and a groove which the upwardly directed part of the vertical leg of the connecting structural support engages, and wherein the panels conceal the connecting structural supports.

13. The mounting system as claimed in claim 1, comprising a connecting structural support attached at an upper end of the vertical structural support.

14. The mounting system as claimed in claim 1, wherein the base structural support has at least one opening in its horizontal leg.

15. The mounting system as claimed in claim 1, wherein the connecting structural supports have at least one opening in the vertical leg which is connected to the vertical structural support.

16. The mounting system as claimed in claim 3, wherein a rectangular structural support is inserted into the rectangular hollow structural supports of the base structural supports and is rigidly connected to at least one of the base structural supports.

17. The mounting system as claimed in claim 7, wherein a rectangular structural support is inserted into the rectangular hollow structural supports of the connecting structural supports and is rigidly connected to at least one of the connecting structural supports.

18. The mounting system as claimed in claim 1, wherein the upper horizontal leg of the connecting structural support has an angled lower side, and the vertical leg is reinforced in comparison with the upwardly and downwardly directed vertical leg, and the lower horizontal leg.

19. A mounting system for panels for use in facade cladding on buildings and for invisible fastening of the panels on structural supports said mounting system being adapted to be connected to a building wall, wherein the mounting system (1) comprises base structural supports (2; 3) and connecting structural supports (4; 5) which are fastened horizontally to vertical structural supports (6), the vertical structural supports (6) being connectable to the building wall (7), wherein each base structural support (2; 3) has a U-like cross section, in which cross section the upwardly directed leg (8) is shorter than the leg (9) fastened to the vertical structural supports (6), and wherein each connecting structural support (4; 5) has a short, upwardly and downwardly directed leg (10) that is connected to the vertical structural supports (6), a horizontal leg (22, 24), which has a flexible elastic insert (13) at its open end, adjoining the lower end of a vertical leg (11).

* * * * *